US009845989B1

(12) United States Patent
Veiga

(10) Patent No.: US 9,845,989 B1
(45) Date of Patent: Dec. 19, 2017

(54) THERMAL SLEEVES FOR BOTTLE

(71) Applicant: Carla Veiga, Randolph, MA (US)

(72) Inventor: Carla Veiga, Randolph, MA (US)

( * ) Notice: Subject to any disclaimer, the term of this patent is extended or adjusted under 35 U.S.C. 154(b) by 168 days.

(21) Appl. No.: 14/881,306

(22) Filed: Oct. 13, 2015

(51) Int. Cl.
*F25D 31/00* (2006.01)

(52) U.S. Cl.
CPC ..... *F25D 31/007* (2013.01); *F25D 2331/803* (2013.01)

(58) Field of Classification Search
CPC ..... F25D 31/007; F25D 2331/803
See application file for complete search history.

(56) References Cited

U.S. PATENT DOCUMENTS 4,281,520 A * 8/1981 Norwood ..... F25D 3/08 62/372
4,401,245 A 8/1983 Zills
4,793,149 A * 12/1988 Riche ..... B65D 81/3883 165/46
5,406,808 A * 4/1995 Babb ..... A47J 41/0005 220/379
5,797,528 A 8/1998 McDuffie
6,412,300 B2 * 7/2002 Kaposi ..... A47G 19/2288 62/457.2
6,464,100 B2 10/2002 Canfield
6,732,533 B1 * 5/2004 Giles ..... F25B 21/04 62/244
7,614,516 B2 * 11/2009 Beggins ..... B65D 81/3879 215/386
8,256,411 B2 9/2012 Christy
2005/0257562 A1 11/2005 Wilson
2005/0279751 A1 12/2005 Dempsey
2006/0076128 A1 * 4/2006 Pascuzzi ..... F02M 31/20 165/172
2012/0064470 A1 * 3/2012 Delattre ..... A47J 36/2433 432/29

* cited by examiner

*Primary Examiner* — Emmanuel Duke
(74) *Attorney, Agent, or Firm* — Kyle A. Fletcher, Esq.

(57) ABSTRACT

The thermal sleeves for bottle includes a bottle that includes a sealable closure at a top opening. The exterior of the bottle enables at least one thermal sleeve to be affixed there against in order to increase the overall insulative quality of the bottle. The at least one thermal sleeve may include at least one layer of a freezer gel material, which when placed into a freezer becomes hardened. The at least one thermal sleeve also includes a storage compartment that is accessible via a top opening. The top opening of the at least one thermal sleeve includes a sealing member to selectively close and unseal the top opening. The storage compartment is ideally used to store a powder that may be mixed into a fluid provided in the bottle.

10 Claims, 6 Drawing Sheets

THERMAL SLEEVES FOR BOTTLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of drinking vessels, more specifically, a bottle with removable thermal sleeves.

SUMMARY OF INVENTION

The thermal sleeves for bottle includes a bottle that includes a sealable closure at a top opening. The exterior of the bottle enables at least one thermal sleeve to be affixed there against in order to increase the overall insulative quality of the bottle. The at least one thermal sleeve may include at least one layer of a freezer gel material, which when placed into a freezer becomes hardened. The at least one thermal sleeve also includes a storage compartment that is accessible via a top opening. The top opening of the at least one thermal sleeve includes a sealing member to selectively close and unseal the top opening. The storage compartment is ideally used to store a powder that may be mixed into a fluid provided in the bottle. The at least one thermal sleeve includes a channel armature that is longitudinally oriented, and corresponds with a channel integrated into the bottle. The channel armature of the at least one thermal sleeve locks into the channel provided on the outer surface of the bottle.

It is an object of the invention to provide a bottle with a sealable closure, and at least one thermal sleeve that is able to secure itself around an exterior of the bottle to enhance the thermal quality of the bottle in keeping a beverage insulated.

A further object of the invention is for the thermal sleeve to include an opening that enables a mixing powder to be stored therein, and be dispensed there from in order to mix with a fluid stored in said bottle.

These together with additional objects, features and advantages of the thermal sleeves for bottle will be readily apparent to those of ordinary skill in the art upon reading the following detailed description of the presently preferred, but nonetheless illustrative, embodiments when taken in conjunction with the accompanying drawings.

In this respect, before explaining the current embodiments of the thermal sleeves for bottle in detail, it is to be understood that the thermal sleeves for bottle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the thermal sleeves for bottle.

It is therefore important that the claims be regarded as including such equivalent construction insofar as they do not depart from the spirit and scope of the thermal sleeves for bottle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
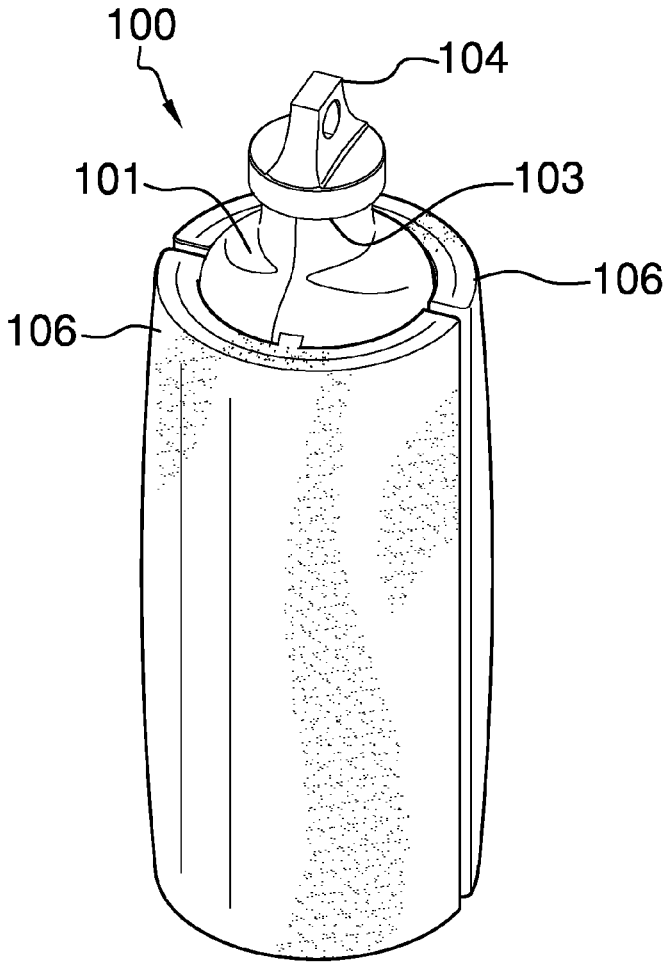
FIG. 1 is a perspective view of an embodiment of the disclosure.
Figure 2:
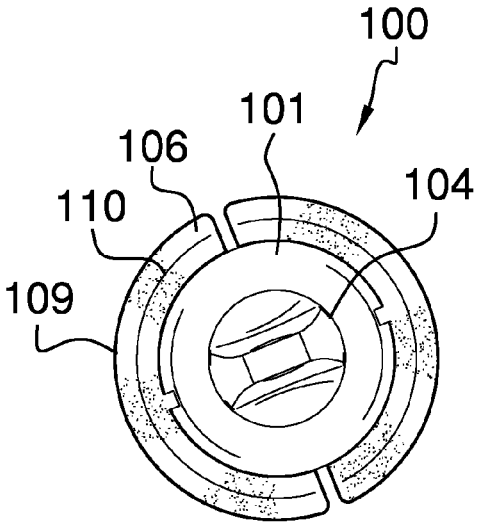
FIG. 2 is a top view of an embodiment of the disclosure.
Figure 3:
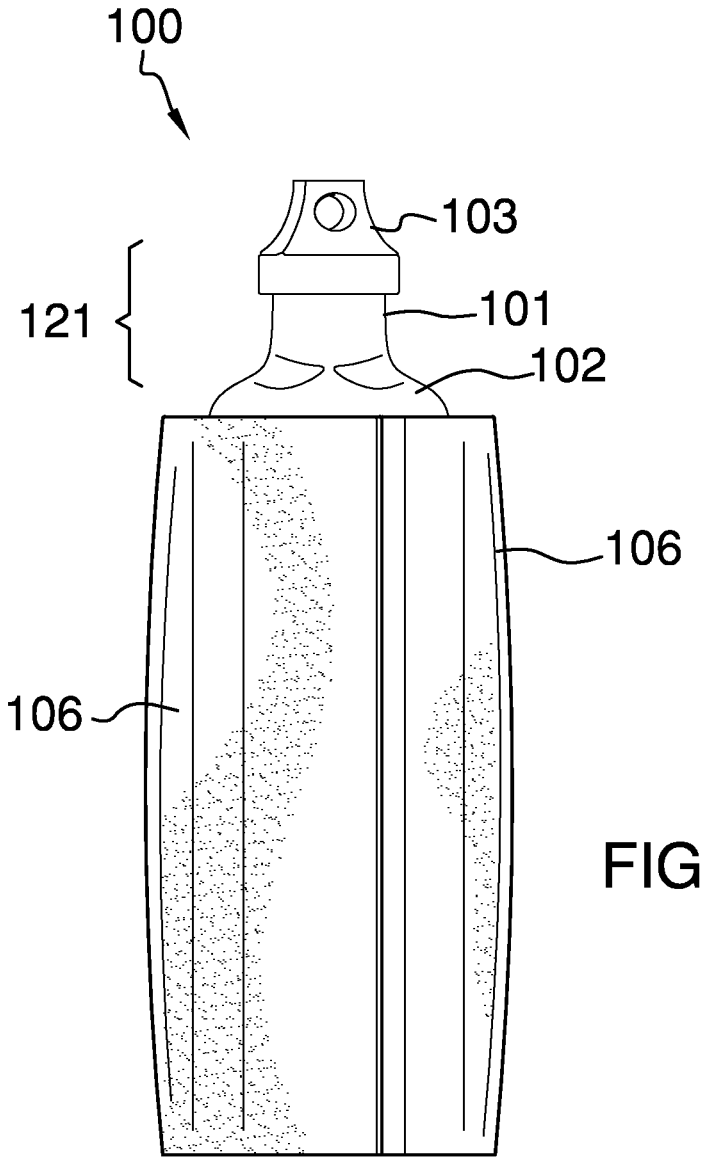
FIG. 3 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7. The thermal sleeves for bottle 100 (hereinafter invention) comprises a bottle 101 further defined with an outer surface 102 and a bottle top opening 103. A sealable closure 104 is included, and used to selectively seal off the bottle top opening 103 of the bottle 101. The term sealable closure 104 is a fancy term for bottle cap.

The bottle 101 includes at least one channel 105 provided on the outer surface 102. The at least one channel 105 is longitudinally oriented, and enables at least one thermal sleeve 106 to be secured against the outer surface 102 of the bottle 101. The at least one channel 105 corresponds with a channel armature 107 provided on a first, inner surface 108 of the at least one thermal sleeve 106. The at least one thermal sleeve 106 is further defined with a second, outer surface 109 that is opposite the first, inner surface 108.

Figure 4:
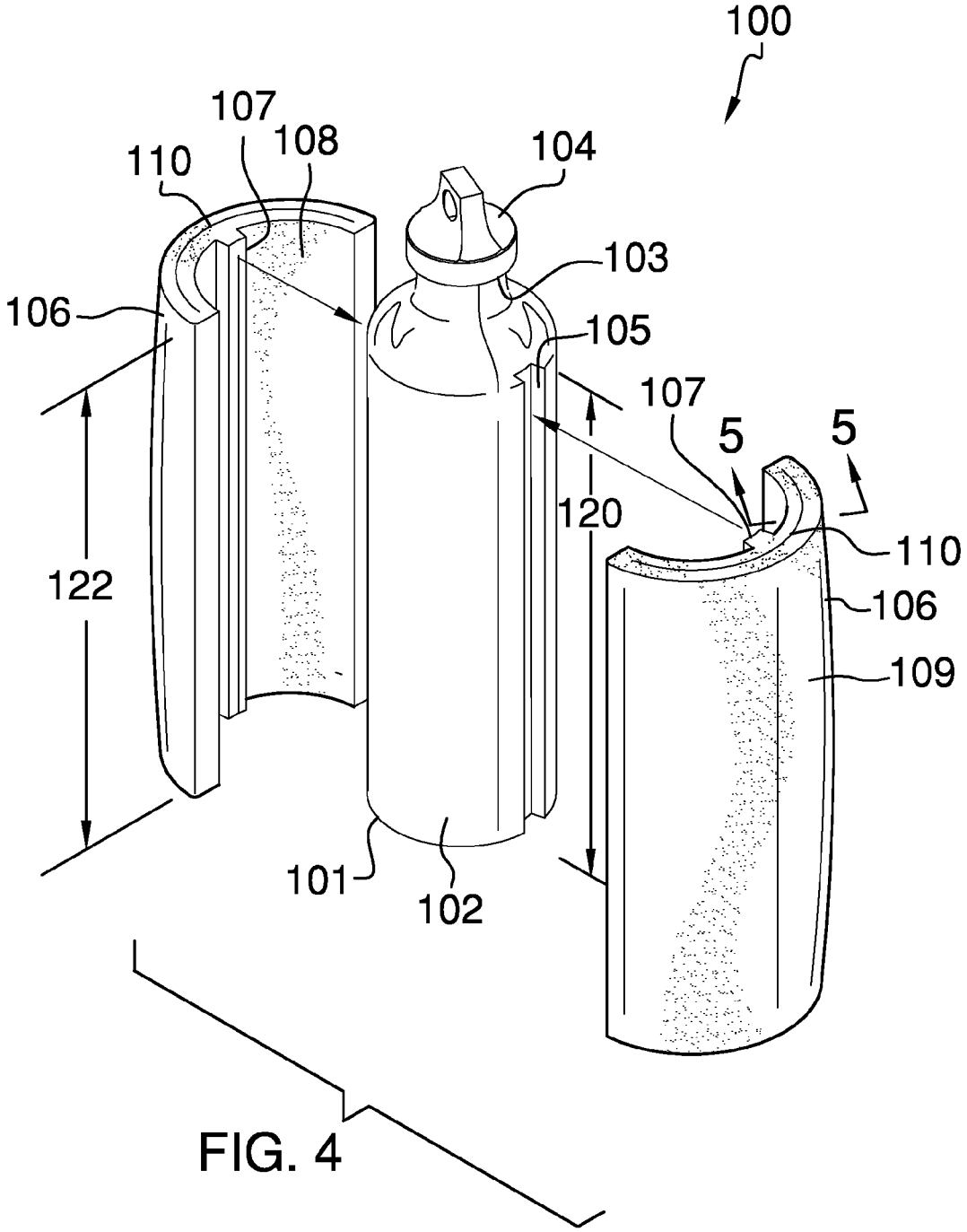
FIG. 4 is an exploded view of an embodiment of the disclosure.
Figure 7:
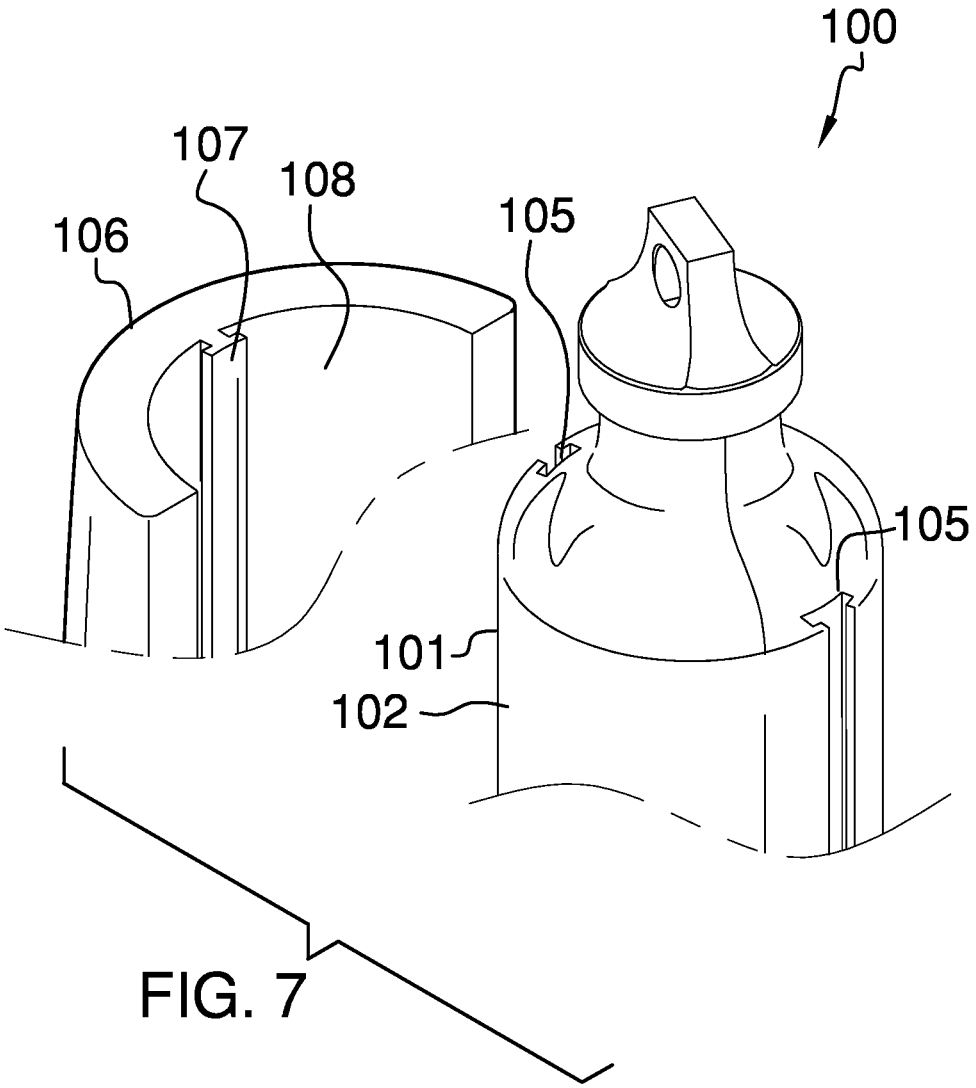
FIG. 7 is a perspective view of an alternative embodiment of the disclosure.

The channel armature 107 enables the at least one thermal sleeve 106 to be affixed against the outer surface 102 of the bottle 101. The first, inner surface 108 of the at least one thermal sleeve 106 has a curvature consistent with the outer surface 102 of the bottle 101. Referring to FIGS. 4 and 7, the channel armature 107 and the at least one channel 105 may vary depending on the embodiment. In FIG. 7, the channel armature 107 and the at least one channel 105 have a "T"-shaped cross section, which provides a secure connection between the bottle 101 and the at least one thermal sleeve 106.

The at least one thermal sleeve 106 includes a top thermal opening 110. Moreover, the at least one thermal sleeve 106 is constructed of a flexible material, which enables the top thermal opening 110 to be opened and closed as needed (see FIG. 6). The top thermal opening 110 includes a seal closure member 111 thereon, which enables a storage compartment 112 of the at least one thermal sleeve 106 to be sealed or opened as needed. The storage compartment 112 enables a first material 113 to be selectively stored within the storage compartment 112, and retrieved as needed.

Figure 5:
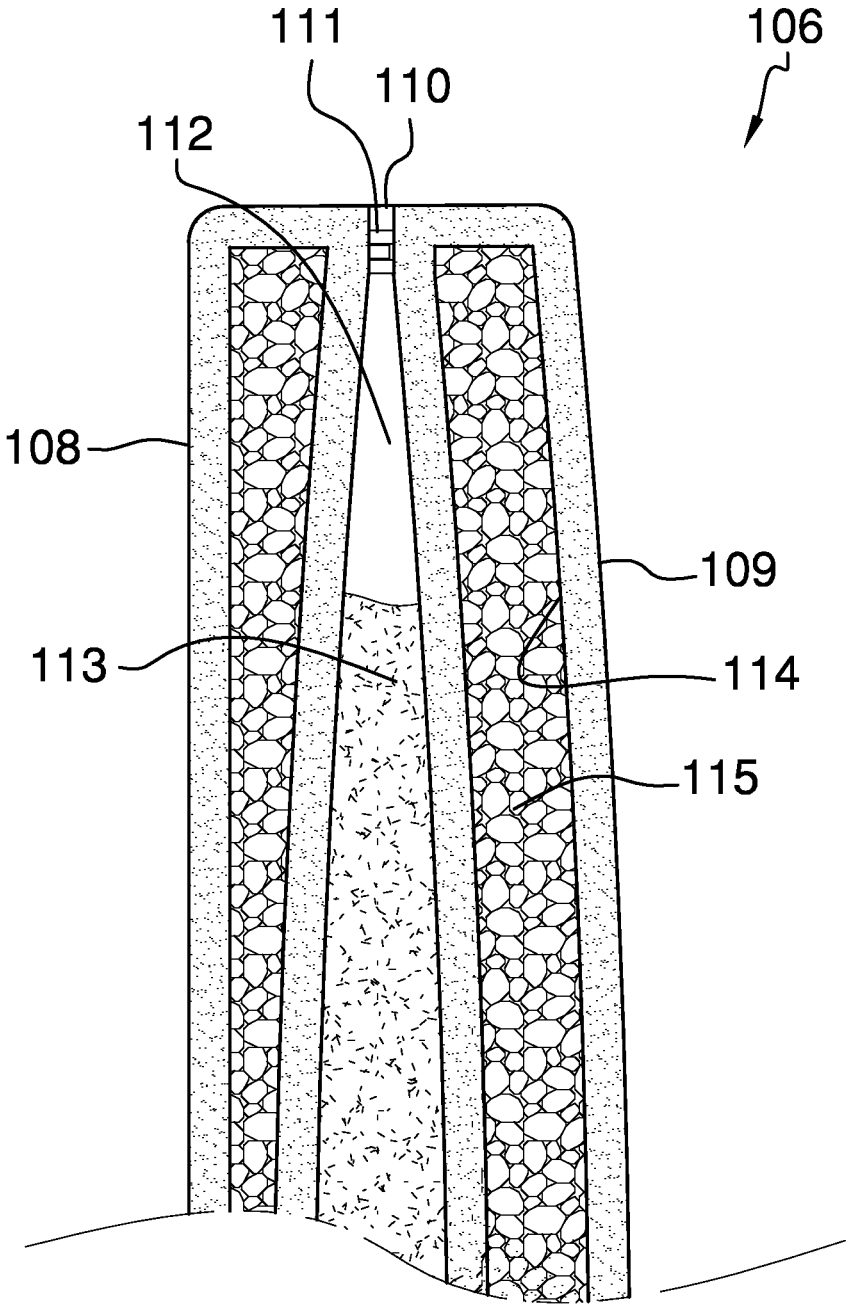
FIG. 5 is a cross-sectional view of an embodiment of the disclosure along line 5-5 in FIG. 4.
Figure 6:
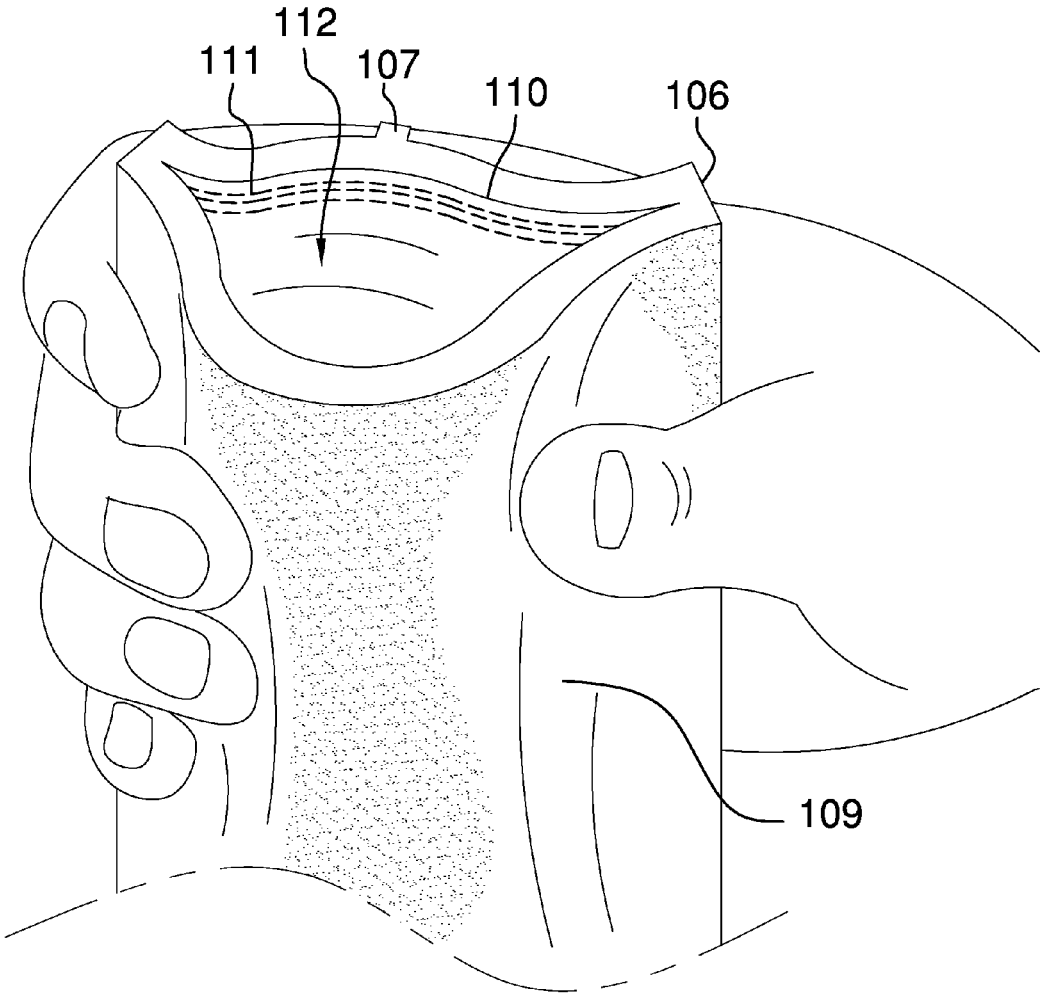
FIG. 6 is a detail view of an embodiment of the disclosure.

Referring to FIG. 5, the at least one thermal sleeve 106 is further defined with at least one freezer gel compartment 114. The at least one freezer gel compartment 114 is positioned between the storage compartment 112 and either the first, inner surface 108 and/or the second, outer surface 109. The at least one freezer gel compartment 114 is filled with a freezer gel 115 that when subjected to below freezing temperatures hardens in order to provide cool to the bottle 101. Also, the at least one freezer gel compartment 114 enhances the thermal quality when the at least one thermal sleeve 106 is affixed to the bottle 101. The freezer gel 115 is a term being used to loosely refer to gel packs or ice packs that are commonly sold and used in coolers, and which contains a refrigerant gel or liquid.

Referring to FIG. 4, the bottle 101 is further defined with a bottle length 120. The bottle length 120 extends along a planar portion of the bottle 101, and not a neck portion 121 of the bottle 101. The bottle length 120 is consistent with a sleeve length 122 of the at least one thermal sleeve 106. The at least one thermal sleeve 106 is adapted to interface with the bottle 101 such that the sleeve length 122 of the at least one thermal sleeve 106 is consistent with the bottle length 120 of the bottle 101.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A thermal sleeves for bottle comprising:

a bottle with at least one thermal sleeve selectively secured against an outer surface of the bottle in order to enhance an insulative quality of said bottle;

wherein the bottle is further defined with an outer surface and a bottle top opening;

wherein a sealable closure is included, and used to selectively seal off the bottle top opening of the bottle;

wherein the bottle includes at least one channel provided on the outer surface;

wherein the at least one channel is longitudinally oriented, and enables at least one thermal sleeve to be secured against the outer surface of the bottle;

wherein the at least one channel corresponds with a channel armature provided on the at least one thermal sleeve;

wherein the channel armature is provided on a first, inner surface of the at least one thermal sleeve;

wherein the at least one thermal sleeve is further defined with a second, outer surface that is opposite the first, inner surface;

wherein the channel armature enables the at least one thermal sleeve to be affixed against the outer surface of the bottle;

wherein the first, inner surface of the at least one thermal sleeve has a curvature consistent with the outer surface of the bottle;

wherein the channel armature and the at least one channel have a "T"-shaped cross section, which provides a secure connection between the bottle and the at least one thermal sleeve.

2. The thermal sleeves for bottle according to claim 1 wherein the at least one thermal sleeve includes a top thermal opening.

3. The thermal sleeves for bottle according to claim 2 wherein the at least one thermal sleeve is constructed of a flexible material, which enables the top thermal opening to be opened and closed as needed; wherein the top thermal opening includes a seal closure member thereon, which enables a storage compartment of the at least one thermal sleeve to be sealed or opened as needed.

4. The thermal sleeves for bottle according to claim 3 wherein the storage compartment enables a first material to be selectively stored within the storage compartment, and retrieved as needed.

5. The thermal sleeves for bottle according to claim 4 wherein the at least one thermal sleeve is further defined with at least one freezer gel compartment.

6. The thermal sleeves for bottle according to claim 5 wherein the at least one freezer gel compartment is positioned between the storage compartment and either the first, inner surface and/or the second, outer surface.

7. The thermal sleeves for bottle according to claim 6 wherein the at least one freezer gel compartment is filled with a freezer gel that when subjected to below freezing temperatures hardens in order to provide cool to the bottle.

8. The thermal sleeves for bottle according to claim 7 wherein the bottle is further defined with a bottle length.

9. The thermal sleeves for bottle according to claim 8 wherein the bottle length extends along a planar portion of the bottle, and not a neck portion of the bottle.

10. The thermal sleeves for bottle according to claim 9 wherein the bottle length is consistent with a sleeve length of the at least one thermal sleeve; wherein the at least one thermal sleeve is adapted to interface with the bottle such that the sleeve length of the at least one thermal sleeve is consistent with the bottle length of the bottle.

* * * * *